US005232154A

United States Patent [19]

Jenkins et al.

[11] Patent Number: 5,232,154

[45] Date of Patent: Aug. 3, 1993

[54] CHILDREN'S RIDE-ON TRACK

[75] Inventors: Pat Jenkins, 3590 Vinings Ridge Ct., Atlanta, Ga. 30339; Cathy Gentry, 608 Ashford Pl., Newport News, Va. 23602

[73] Assignees: Patricia M. Jenkins; Cathy J. Gentry

[21] Appl. No.: 897,418

[22] Filed: Jun. 12, 1992

[51] Int. Cl.[5] ..... E01B 23/00

[52] U.S. Cl. ..... 238/10 F; 104/62; 482/68; 472/15; 472/89; 446/446

[58] Field of Search ..... 238/10 R, 10 A, 10 B, 238/10 C, 10 E, 10 F; 104/53, 62, 118, 119; 482/68, 69; 472/14, 15, 26, 85, 88, 89, 90; 404/18, 34; 446/444, 445, 446

[56] References Cited

U.S. PATENT DOCUMENTS

| | | | |
|---|---|---|---|
| 363,899 | 5/1887 | Lane et al. | 482/68 |
| 592,569 | 10/1897 | Lehmann | 482/68 X |
| 642,435 | 1/1900 | Firnhaber | 104/62 |
| 671,058 | 4/1901 | Resetar | 482/68 X |
| 2,068,403 | 1/1937 | Ekstrom | 238/10 F X |
| 2,318,958 | 5/1943 | Murphy | 104/53 |
| 2,638,345 | 5/1953 | Norvell | 472/21 |
| 2,761,683 | 9/1956 | Stancliff | 104/53 X |
| 2,787,970 | 4/1957 | Bennett | 104/62 X |
| 3,266,800 | 8/1966 | Yee | 472/89 |
| 3,587,190 | 6/1971 | Ashton | 238/10 E X |
| 3,734,404 | 5/1973 | Baynes et al. | 238/10 E |
| 3,893,666 | 7/1975 | Parsons | 472/21 |
| 4,795,151 | 1/1989 | Mulcaster | 482/68 |
| 5,016,540 | 5/1991 | Barber | 104/53 |
| 5,069,311 | 12/1991 | Young | 482/68 X |

FOREIGN PATENT DOCUMENTS

| | | | |
|---|---|---|---|
| 540797 | 12/1931 | Fed. Rep. of Germany | 482/68 |

*Primary Examiner*—Michael S. Huppert
*Assistant Examiner*—Scott L. Lowe

[57] ABSTRACT

Provided is a track of elongated sections which interlock together to form various desired shaped. Each section has a safety securement device consisting of a "T"-bar slot (12) in its center. A rigid "T"-bar (16) is connected with a hook-end-loop strip (17) to the rear of a child's ride-on, toy vehicle. The "T"-bar (16) cooperates with the "T"-bar slot (12) to allow controlled movement of the toy vehicle along the track. The track may also be provided with raised, bumper guards along its edges to aid in keeping the child's vehicle within the confines of the track.

6 Claims, 4 Drawing Sheets

CHILDREN'S RIDE-ON TRACK

BACKGROUND

Field of Invention

This invention relates to the safe usage of ride-on toy vehicles currently marketed to young children; specifically, it is a portable, novel track devised of individual sections that, when connected together in a desired form, provide a safe and functional environment for usage of said vehicle types and for use in performing other recreational activities and, when said vehicles are secured to track by the use of safety securement device, vehicles are movable and rollable while secured to contained area.

2. Description of Prior Art

Children's ride-on toy vehicles have been around for a long time and are currently marketed to children starting at age one. But, a safe place to ride them does not seem to exist. Today, most children ride toy vehicles on dangerous driveways and roadways around their homes, under Mom's foot in the kitchen, or on outside grassy areas where it is difficult to maneuver.

Fundamental to the concern of all parents and other child care providers is the fear that a child on a movable ride-on toy vehicle will escape attention or supervision for a period sufficiently lengthy to enable the child to encounter a hazard, whereby serious physical damage could be and sometimes is caused to the child. The concept of facilitating hand-eye and leg coordination and development while simultaneously somewhat restraining the child by means of such apparatus is uniformly recognized.

One possible solution is to circumscribe the area of activity of the child on a ride-on toy vehicle. This problem has been addressed by several inventors by limiting the occupant to a restricted movement while operating the vehicle, whereby said vehicle is either permanently attached or trapped in a concave base structure restricting any motion, but forward. Another solution has been to attach a single upright handle to the rear of the vehicle, whereby an adult can hold the handle and walk with the child as the child maneuvers forward; however, hands-on interaction by another individual is required, henceforth, both solutions, while containing the movement of the child, add greater restrictions which may frustrate the child learning to maneuver the vehicle, as well as limiting creativity.

To date, no really satisfactory solution has been provided whereby the multitudes of ride-on toy vehicles currently marketed can be used safely and efficiently, as they were intended to be used by the manufacturer. The present invention addresses the use of ride-on toy vehicles by the occupant thereof in a most efficient and advantageous manner, which has proved highly satisfactory, safe and enjoyable in practice.

In researching, no prior art was revealed specifically pertaining to ride-on tracks; however, several devices such as baby walker and track or ride-on vehicle and track combinations were discovered and are herein disclosed.

U.S. Pat. No. 4,795,151 to Mulcaster, January 1989, discloses a baby walker vehicle and track designed to restrict the infant's movement while he learns to walk. This invention is designed specifically for an infant learning to walk; the preferred embodiment of my invention is to aid young children in the activity of learning to push, pedal or drive a ride-on toy vehicle. My invention does not call for the moving vehicle to be completely attached to the track, as the baby walker does, by anchoring 2 of the 4 wheels to the track, prohibiting all movement except forward motion.

Heretofore, inventors have created several types of ride-on vehicles with accompanying tracks. U.S. Pat. No. 2,787,970 to Bennett, April 1957, discloses a bicycle-like vehicle for children wherein the front wheel is designed to roll along within guide rails which run parallel and trap the front wheel. This invention is pertaining directly to the uniqueness of a new ride-on vehicle, whereas my track invention can be used with many types of existing ride-on toy vehicles, thus eliminating the additional expense of the track/vehicle combined purchase; further, my invention allows the child to ride his own favorite toys and expands the effective age range by allowing for the usage of different ride-on toy vehicles as the child grows, gains physical ability or desires a more complex vehicle. Additionally, my invention does not require the front portion of a ride-on toy vehicle to be attached or rest in any permanent position relating to the track; therefore, the child has the ability to steer the vehicle, thereby providing the opportunity to learn driving techniques.

U.S. Pat. No. 2,318,958 to Murphy, May 1943, discloses a car-type vehicle and riding track. The track acts as a straight section of a roller coaster sloping down. Again, this invention is limited to the included car-type vehicle; and it fails to allow the child to maneuver the vehicle. Additionally, it is designed as a one time "amusement ride," rather than a continuous riding track, with no versatility in size and shape.

OBJECTS AND ADVANTAGES

Accordingly, several objects and advantages of my invention are:

(a) to provide a safe and controlled environment allowing children to have fun while learning to ride toy vehicles and while using other recreational devices, i.e., roller skates, skate boards, etc.;

(b) to provide children the ability to use their own favorite ride-on toy vehicle and to use alternate ride-on toys of the child's choice as he matures and desires additional challenges or entertainment;

(c) to aid in providing the child with an activity that develops motor skills and dexterity without compromising safety;

(d) to inspire a child's creativity and imagination as he pretends to be on a real roadway;

(e) to provide the child the ability to move the ride-on toy vehicle from left to right, while remaining within the confines of a track;

(f) to provide versatility with size and shape of track to accommodate spacial requirements;

(g) to provide the child specific freedom to maneuver a ride-on toy vehicle while learning steering techniques with no additional hands-on involvement by parent or care-giver; and (h) to provide add-on track sections that further stimulate and challenge as the child develops and grows.

Further objects and advantages are to provide certain functions and accessories which will further challenge and entertain the child and add growth potential to the invention. Still further objects and advantages of my invention will become apparent from a consideration of the drawings and ensuing description of it.

DRAWINGS AND FIGURES

Attention is now directed to the drawings for a further understanding of the invention, wherein:

FIG. 1*a* shows a basic track assembly (top view).

FIG. 1*b* shows an optional design of track assembly (top view).

REFERENCE NUMERALS IN DRAWINGS

10—track section
12—"T"-bar slot
13—interlocking device for track sections
16—rigid "T"-bar
17—hook-and-loop strip
18—side bumper guards

DESCRIPTION—FIGS. 1 to 4

Figure 1A:
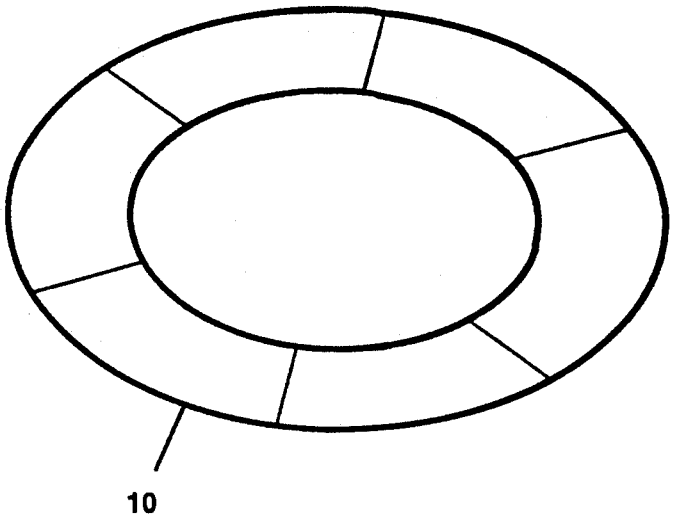
Figure 1B:
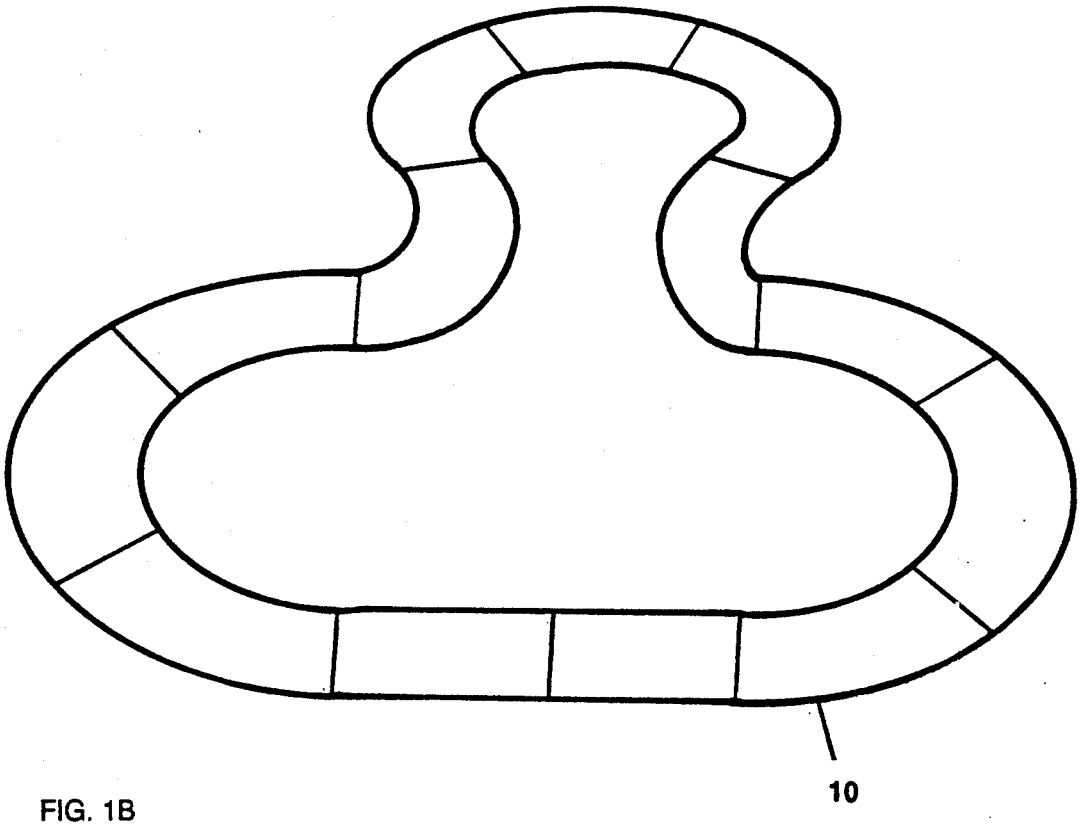
Figure 2:
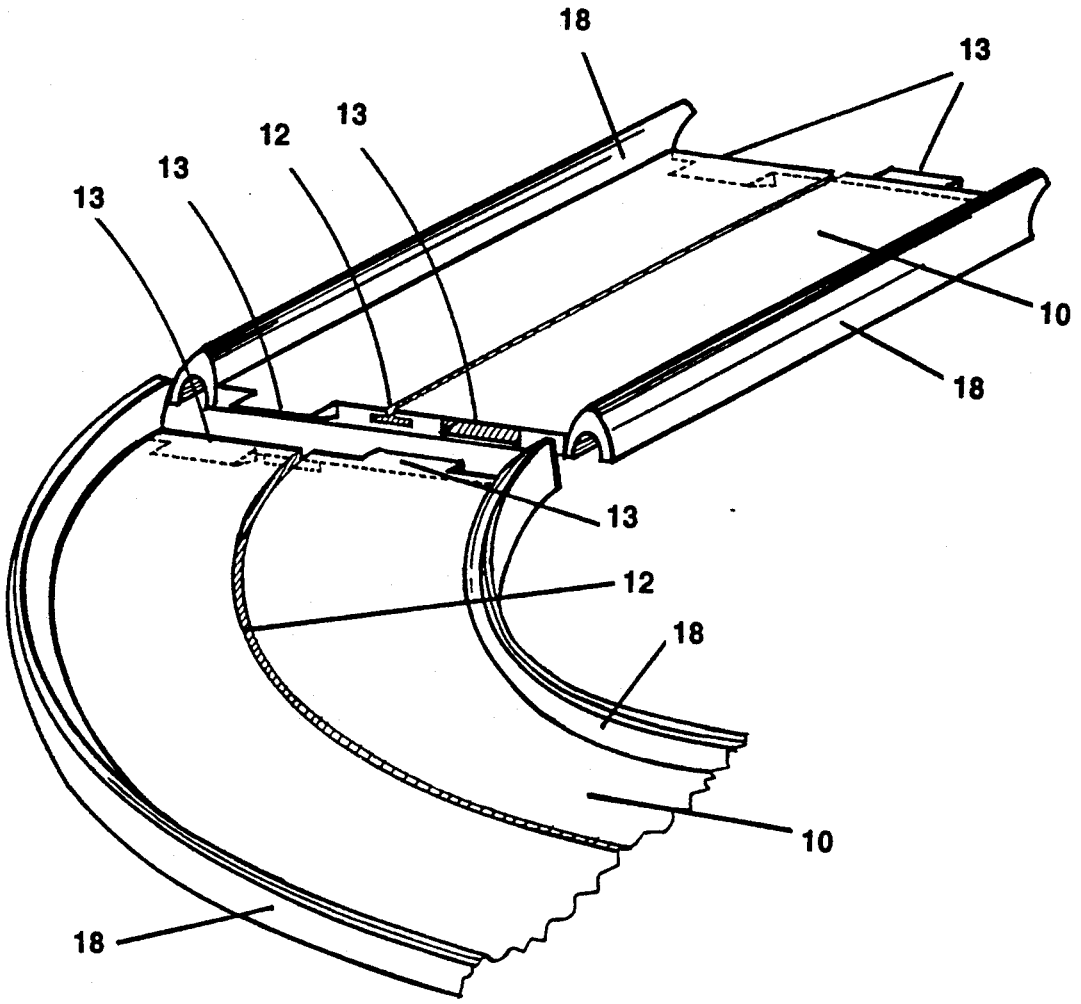
FIG. 2 shows a perspective view of two sections of center grooved track.
Figure 3:
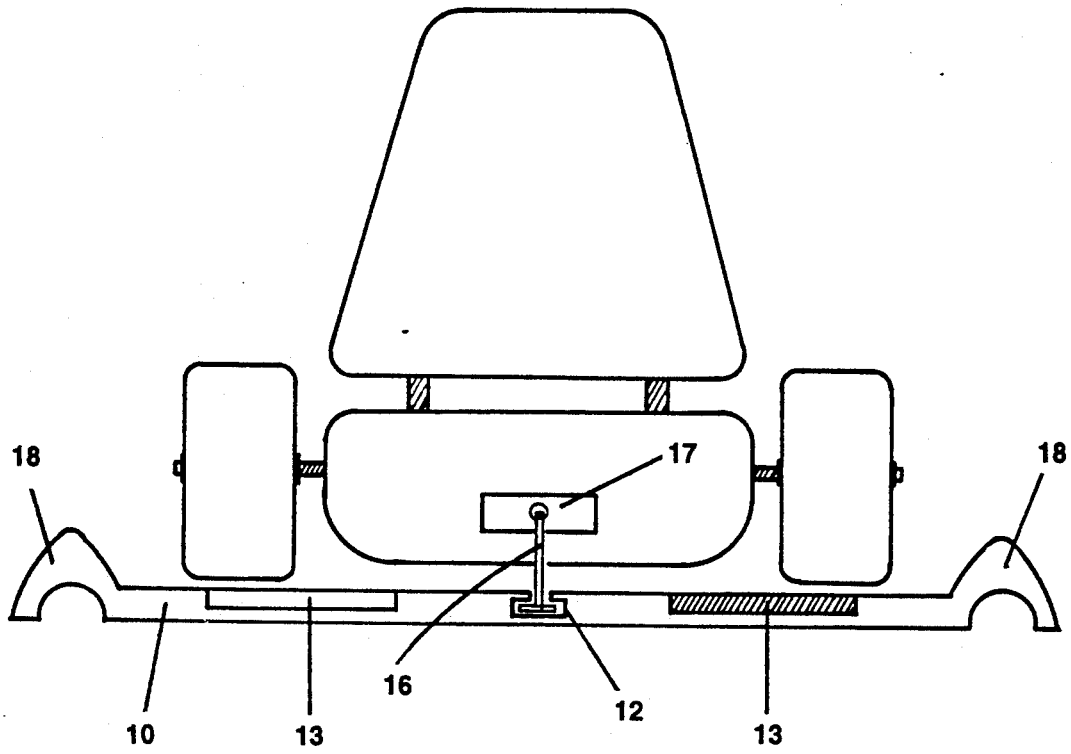
FIG. 3 shows an end-view of a track section with a ride-on toy vehicle attached

Referring now to the drawings, the same numbers refer to the same elements throughout the drawings. FIG. 1*a* and FIG. 1*b* show the basic track and an optional design assembly. The track sections are elongated and made of a durable, lightweight, rigid, weather-resistant material. They are stable in their connection by means of an interlocking device (13), shown in partial phantom on FIG. 2. In the preferred embodiment each track section (10) is of sufficient width as to accommodate said ride-on toy vehicles. Elongated sides of said sections have raised edge side bumper guards (18), as shown in FIG. 3, which prohibit the vehicle from rolling off the track. Track sections (10) have a safety securement device consisting of a center groove or "T"-bar slot (12), as shown in detail in FIG. 4. The ride-on toy vehicle attaches to the track section as shown in FIG. 3. Said "T"-bar slot (12) is recessed into the track and has a partially obscured opening, as shown in FIG. 2.

Figure 4:
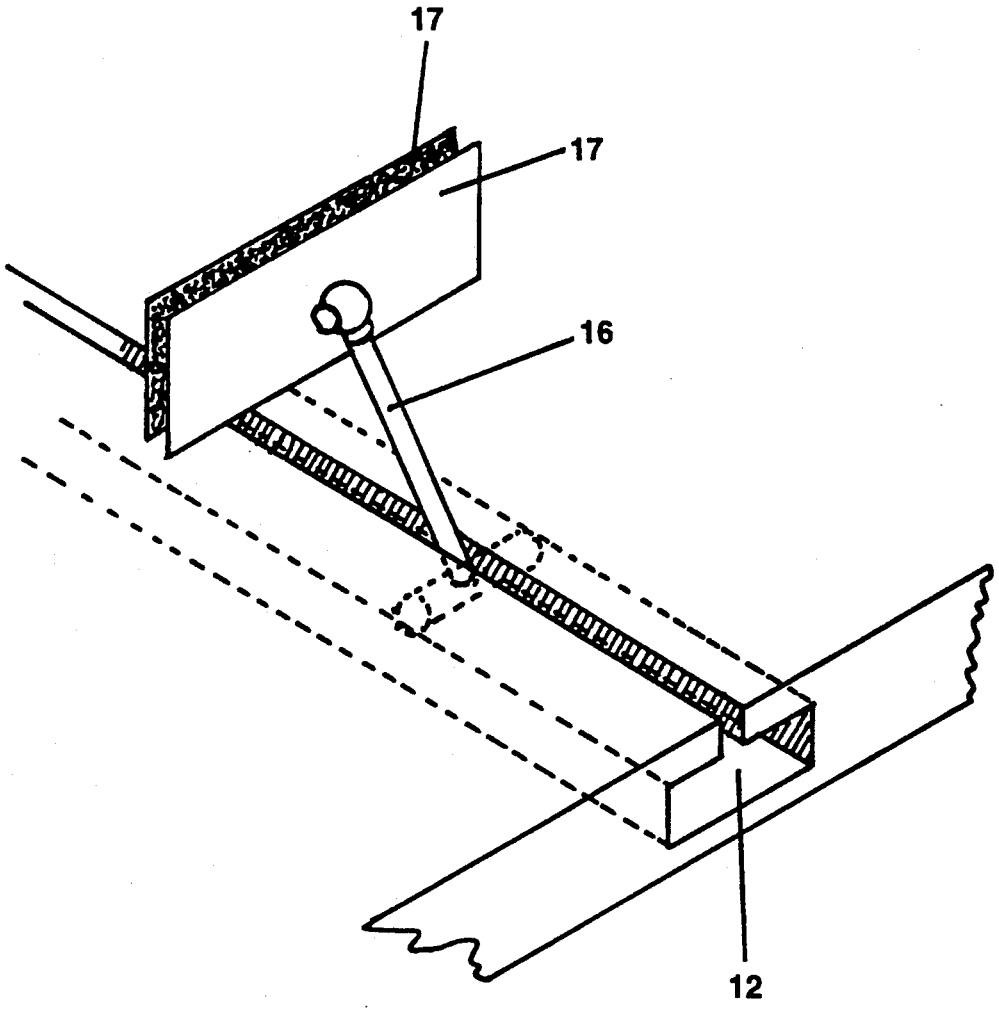
FIG. 4 shows a detail of a safety securement device which attaches the vehicle to the track.

FIG. 3 shows a complimentary safety device in the form of a rigid "T"-bar (16) connected into "T"-bar slot (12) of track section (10). The "T"-bar is made of coated steel-like material and is connected to a hook-and-loop strip (17) as shown in FIG. 4. The hook-and-loop strip is attached to the lower rear-end of the vehicle as shown in FIG. 3.

OPERATION—FIGS. 1*a*, 3, 4

The manner of using the ride-on track: One connects track sections (10) together end-to-end, using interlocking device (13), in the desired shape, forming a stable, uniform surface with no height differentiation between sections. Various shapes can be formed, such as, but not limited to, a circle, as shown in FIG. 1*a*. Inserting the rigid "T"-bar (16) into the "T"-bar slot (12) of the track and turning it perpendicular to the center groove will secure the safety device as detailed in FIG. 4. The rigid "T"-bar is allowed to run smoothly along the track surface, being operational and removable by an adult. The ride-on toy vehicle is placed on the track, and the hook-and-loop strip (17) is attached to the lower rear of the vehicle. Both pieces of the hook-and-loop strip are joined.

FIG. 3 shows the ride-on toy vehicle secured to the track on which the occupant moves the vehicle along, whereas the occupant is allowed freedom of movement while said vehicle is anchored to track.

SUMMARY, RAMIFICATIONS AND SCOPE

Accordingly, the reader will see that by simply attaching a ride-on toy vehicle to the track, a safe and controlled environment is accomplished. In addition, my invention provides a new and creative way for children to master motor skills while staying away from dangerous streets and driveways. Furthermore, the ride-on track has the additional advantages in that

- it allows children to maneuver the ride-on toy vehicle themselves, freely, including left to right motion;
- it provides a way to aid in the development of children's motor skills and physical fitness in an entertaining and fun environment;
- it provides children the advantage of learning certain driving techniques safely, such as negotiating curves and staying in the middle of a lane;
- it provides versatility for use in or outside the home, being adjustable to most size yards or rooms;
- it permits the intended use of currently sold ride-on toy vehicles, including the use of a wide range of sophisticated ride-on toy vehicles, expanding the effective age range;
- it provides the child with an environment that stimulates creativity and imagination; and
- it alleviates the need for hands-on adult supervision, with side bumper guards and optional safety securement devices containing the area of movement.

Although the description above contains many specificities, these should not be construed as limiting the scope of the invention but as merely providing illustrations of some of the presently preferred embodiments of this invention. For example, the track can form many other shapes, such as squares, rectangles of any dimensions and pear shapes; many optional add-on track sections and accessories can be provided, such as track sections that have built-in sprinklers for providing water fun, passing lane sections to accommodate 2 or more riders, bumpy-ride sections, snap-on mail boxes, traffic signs, etc. Also, use of the safety securement device can be an optional function, if not desired.

The invention also provides a secondary usage for owners of radio controlled cars. The track used, as is, is ideal for racing two or more cars.

Thus, the scope of the invention should be determined by the appended claims and their legal equivalents, rather than by the examples given.

I claim:

1. A track for the contained movement of child operated, ride-on toy vehicles, comprising:

(a) elongated sections of a rigid material being sufficient width to accommodate said ride-on toy vehicles;

(b) said sections having interlocking devices on each end, whereby a plurality of said sections may be interconnected so as to form a continuous riding surface for said ride-on vehicle; and (c) said sections having a ride-on toy vehicle safety securement device in the form of a groove, whereby said ride-on toy vehicle's movement is limited in a direction along the width of the sections by a mechanical cooperation with the groove.

2. The track of claim 1, wherein said sections are made of a lightweight, durable, weather-resistant material.

3. The track of claim 1, wherein the interconnections of said sections result in a smooth riding surface.

4. The track of claim 1, wherein said groove is upward opening, the opening being partially obscured by top walls which are smoothly integrated into the riding surface.

5. The track of claim 1, wherein said sections have raised edges along all sides which do not have interlocking devices.

6. The track of claim 5, wherein said raised edges are of sufficient height to prohibit said ride-on toy vehicle from leaving the riding surface.

* * * * *